US009755350B2

(12) United States Patent
Yamada

(10) Patent No.: US 9,755,350 B2
(45) Date of Patent: Sep. 5, 2017

(54) CONNECTOR

(71) Applicant: Sumitomo Wiring Systems, Ltd., Yokkaichi, Mie (JP)

(72) Inventor: Hiroki Yamada, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/237,677

(22) Filed: Aug. 16, 2016

(65) Prior Publication Data

US 2017/0069996 A1 Mar. 9, 2017

(30) Foreign Application Priority Data

Sep. 3, 2015 (JP) ..... 2015-173583

(51) Int. Cl.

| | |
|---|---|
| ***H01R 13/52*** | (2006.01) |
| ***H01R 13/641*** | (2006.01) |
| ***H01R 13/436*** | (2006.01) |
| *H01R 105/00* | (2006.01) |
| *H01R 13/506* | (2006.01) |
| *H01R 13/58* | (2006.01) |

(52) U.S. Cl.

CPC ..... *H01R 13/5208* (2013.01); *H01R 13/4367* (2013.01); *H01R 13/641* (2013.01); *H01R 13/506* (2013.01); *H01R 13/5825* (2013.01); *H01R 2105/00* (2013.01)

(58) Field of Classification Search

CPC H01R 13/424; H01R 13/521; H01R 13/5219; H01R 13/502; H01R 13/5025; H01R 13/5202; H01R 13/5205; H01R 13/641; H01R 13/6295; H01R 13/717; H01R 13/7175

USPC ..... 439/589, 465, 488–491

See application file for complete search history.

(56) References Cited

U.S. PATENT DOCUMENTS 4,794,331 A * 12/1988 Schweitzer, Jr. ..... G01R 19/14 324/133
7,850,482 B2 * 12/2010 Montena ..... H01R 13/6683 340/687
8,819,893 B2 * 9/2014 Shishido ..... F16L 5/02 16/2.2

(Continued)

FOREIGN PATENT DOCUMENTS

JP 2012-238466 12/2012
JP 2012238466 A * 12/2012

*Primary Examiner* — Tulsidas C Patel
*Assistant Examiner* — Travis Chambers
(74) *Attorney, Agent, or Firm* — Gerald E. Hespos; Michael J. Porco; Matthew T. Hespos

(57) ABSTRACT

A waterproof connector (10) includes a retainer (30) composed of divided bodies (31, 32), and a housing (11) including a retainer mounting portion (14) into which the retainer is to be mounted. The retainer mounting portion (14) includes a first mounting portion (16) into which a first of the divided bodies (31) is to be mounted and a second mounting portion (17) into which a second divided body (32) is to be mounted. The first and second divided bodies (31, 32) have facing surfaces (31A, 32A) facing each other. The first divided body (31) includes a projection (31C) that projects toward the second divided body (32) from the facing surface (31A) and a sensor detected portion (38) provided on a back surface (31B) adjacent to the facing surface (31A), and the second divided body (32) includes a recess (32B) into which the projection (31C) is to be fit.

7 Claims, 7 Drawing Sheets

(56) References Cited

U.S. PATENT DOCUMENTS

| | | | | |
|---|---|---|---|---|
| 8,876,547 | B1 * | 11/2014 | Tsai | H01R 13/504<br>29/872 |
| 2014/0213099 | A1 * | 7/2014 | Maranto | H01R 13/5829<br>439/465 |
| 2014/0273608 | A1 * | 9/2014 | Whetstone | H01R 13/625<br>439/488 |
| 2016/0359258 | A1 * | 12/2016 | Koester | H01R 13/436 |

* cited by examiner

CONNECTOR

BACKGROUND

1. Field of the Invention

A technology disclosed by this specification relates to a connector.

2. Description of the Related Art

Japanese Unexamined Patent Publication No. 2012-238466 discloses a shielded connector described with a back retainer for retaining a rubber plug. This shielded connector includes a wire-side housing made of synthetic resin, and wire-side cavities are provided in the wire-side housing for accommodating wire-side terminals. Wire insertion holes are behind the wire-side cavities for accommodating shielded wires, and rubber plugs are accommodated in the wire insertion holes. A back retainer is mounted in a rear end part of the wire-side housing to retain the rubber plugs.

The back retainer is configured by combining a plurality of divided bodies to form cylindrical pressing portions that contact the rubber plugs from behind. Through holes are provided in the pressing portions for allowing passage of the wires. Each through hole is formed by uniting two semicircular portions recessed respectively on a pair of adjacent divided bodies. The sizes of the semicircular portions are determined in accordance with diameters of the shielded wires. However, a new back retainer must be fabricated if the diameters of the shielded wires are changed.

Each divided body of the back retainer is shaped identically if all of the diameters of the shielded wires used in the shielded connector are the same. Thus, it is sufficient to provide one type of divided bodies. However, the shapes of the divided bodies must be different if the diameters of the shielded wires are different. This may cause an assembling error.

SUMMARY

A connector disclosed by this specification includes a retainer composed of divided bodies, and a housing including a retainer mounting portion into which the retainer is to be mounted. The retainer mounting portion includes a first mounting portion into which a first divided body is to be mounted and a second mounting portion into which a second divided body is to be mounted. The divided bodies mounted into the mounting portions have facing surfaces facing each other. The first divided body includes a projection that projects from the facing surface toward the second divided body as a reference and a sensor detected portion is provided on a back surface adjacent to the facing surface. The second divided body includes a recess into which the projection is to be fit.

According to this configuration, an assembling error is detected by a sensor if an existing product not including the sensor detected portion is mounted erroneously into the first mounting portion. Further, if an attempt is made to erroneously mount an existing product not including the recess into the second mounting portion after the first divided body is mounted into the first mounting portion, the existing product interferes with the projection so that an assembling error is detected. Furthermore, if an attempt is made to mount the first divided body into the first mounting portion after an existing product is mounted erroneously into the second mounting portion, the projection of the first divided body interferes with the existing product so that an assembling error is detected. Accordingly, an inspection device, such as a sensor, need not be introduced to confirm that the second divided body is mounted into the second mounting portion.

The retainer may include a through hole allowing the passage of a wire. The through hole may be a space enclosed by a first semicircular portion on the first divided body and a second semicircular portion on the second divided body. The sensor detected portion may project in an axial direction of the wire from the back surface of the first divided body. According to this configuration, an assembling error can be detected by a contact-type sensor sensing the presence or absence of the sensor detected portion.

Two of the projections may be provided at opposite sides of the first semicircular portion and two of the recesses may be provided at opposite sides of the second semicircular portion. According to this configuration, the two projecting portions are fit into the pair of recesses to indicate proper assembly.

According to the connector disclosed by this specification, it is possible to prevent an assembling error with an existing product by a combination of the sensor detected portion, the projection and the recess.

DETAILED DESCRIPTION

Figure 1:
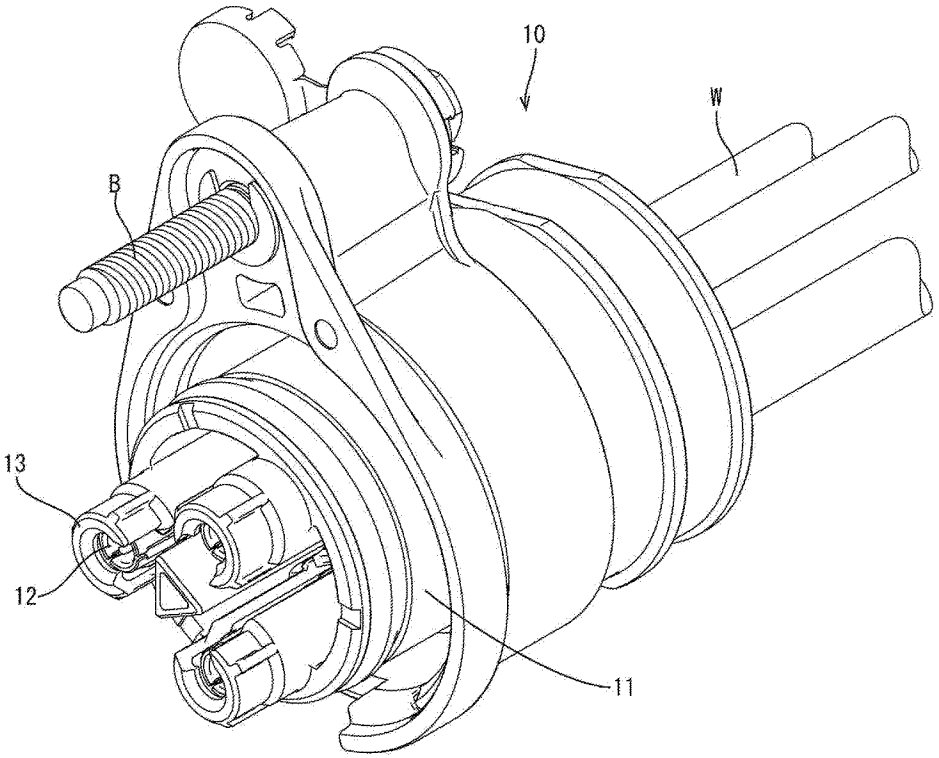
FIG. 1 is a perspective view of a waterproof connector in an embodiment.

A waterproof connector according to an embodiment of the invention is identified by the numeral 10 in FIG. 1 and includes a connection bolt B. The connector 10 is connectable to a device-side connector fixed to an unillustrated device-side case by tightening the connection bolt B into the device-side case. Note that, in the following description, a front-back direction is based on a connecting direction of the connector 10 and the device-side connection, and connection surfaces of the connectors are the front ends.

The waterproof connector 10 includes a housing 11 made of synthetic resin and terminal accommodating portions 13 for accommodating terminals 12 are provided in this housing 11. The terminal 12 includes a substantially cylindrical terminal connecting portion composed of three connection pieces divided from each other by slits. A wire connecting portion to be crimped and connected to a wire W is provided on a rear side of the terminal 12.

Figure 2:
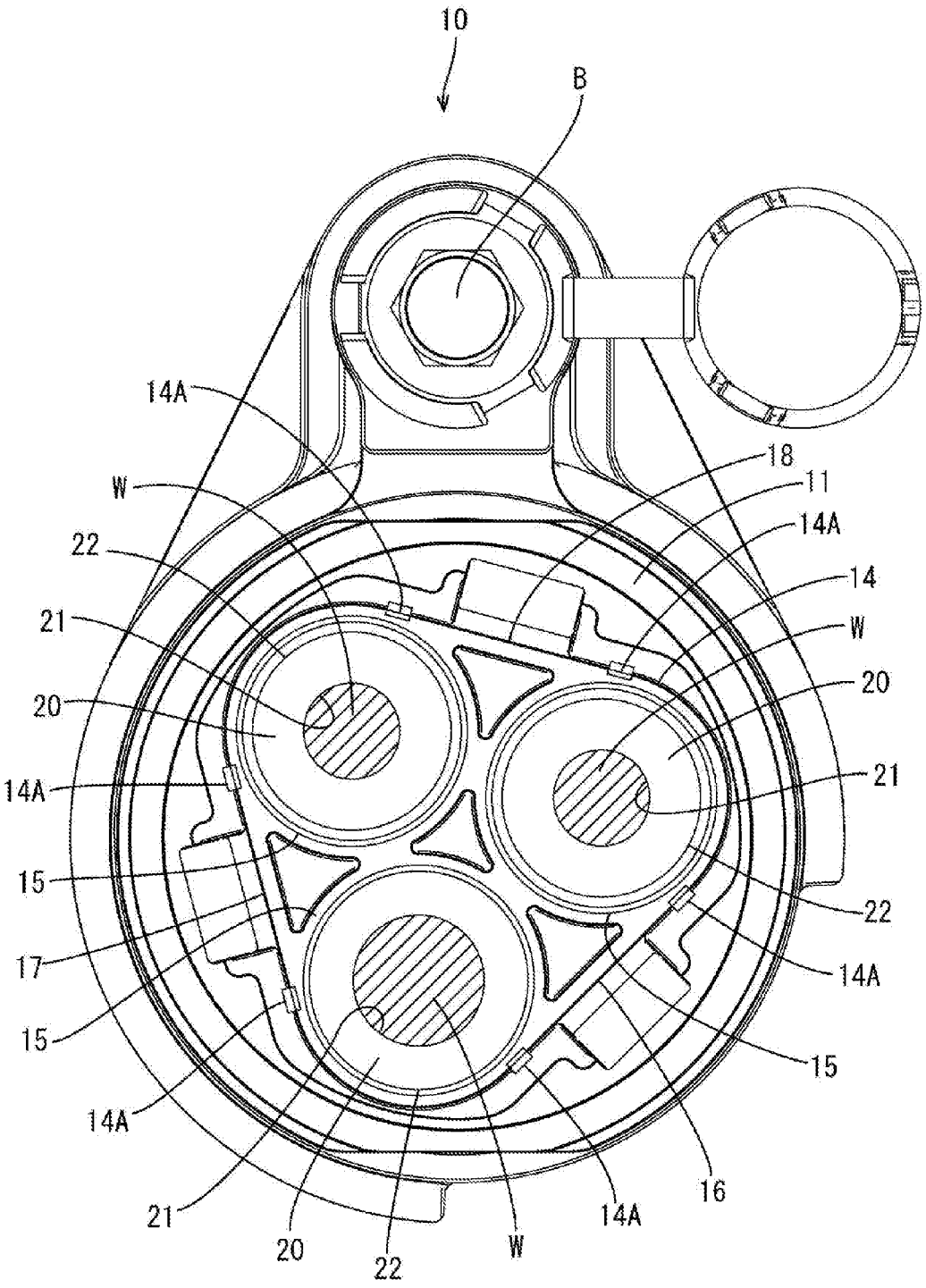
FIG. 2 is a rear view of the waterproof connector before a retainer is mounted.

As shown in FIG. 2, wire accommodating portions 15 are provided in the housing 11 behind the terminal accommodating portions 13 for accommodating the wires W and rubber plugs 20. Inner spaces of the terminal accommodating portions 13 and those of the wire accommodating portions 15 communicate with each other. The rubber plug 20 includes inner peripheral lips 21 for closely contacting the outer peripheral surface of the wire W and outer peripheral lips 22 for closely contacting the inner peripheral surface of the wire accommodating portion 15. The rubber plug 20 is mounted in advance on the wire W and the terminal 12 is inserted into the terminal accommodating portion 13 from behind so that the rubber plug 20 closely contacts the outer peripheral surface of the wire W and the inner peripheral surface of the wire accommodating portion 15. Thereafter, a back retainer 30 is mounted into the housing 11 from behind to retain the rubber plugs 20 and to prevent intrusion of water into the interior of the housing 11 from the wire accommodating portions 15.

Figure 3:
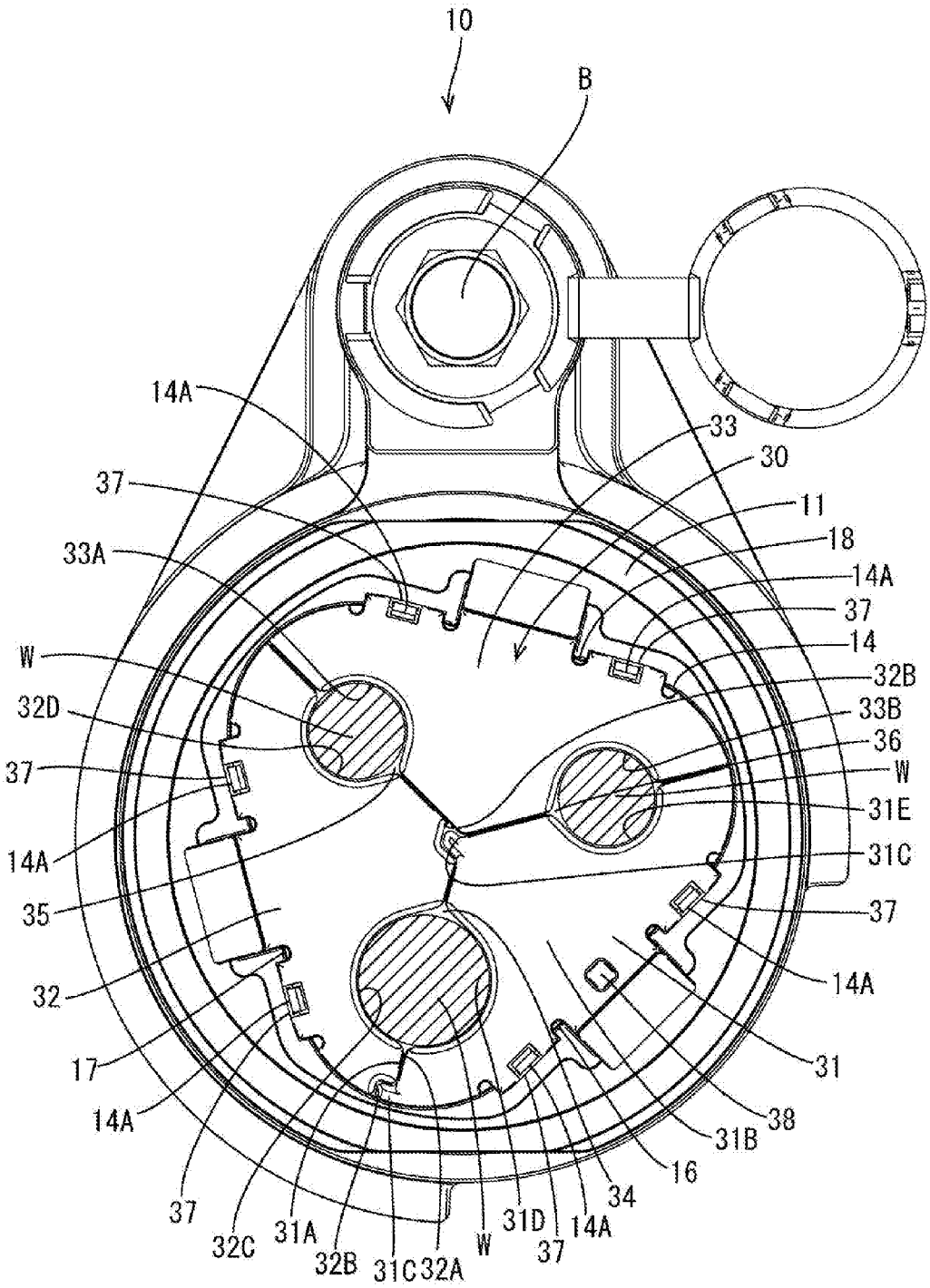
FIG. 3 is a rear view of the waterproof connector after the retainer is mounted.
Figure 4:
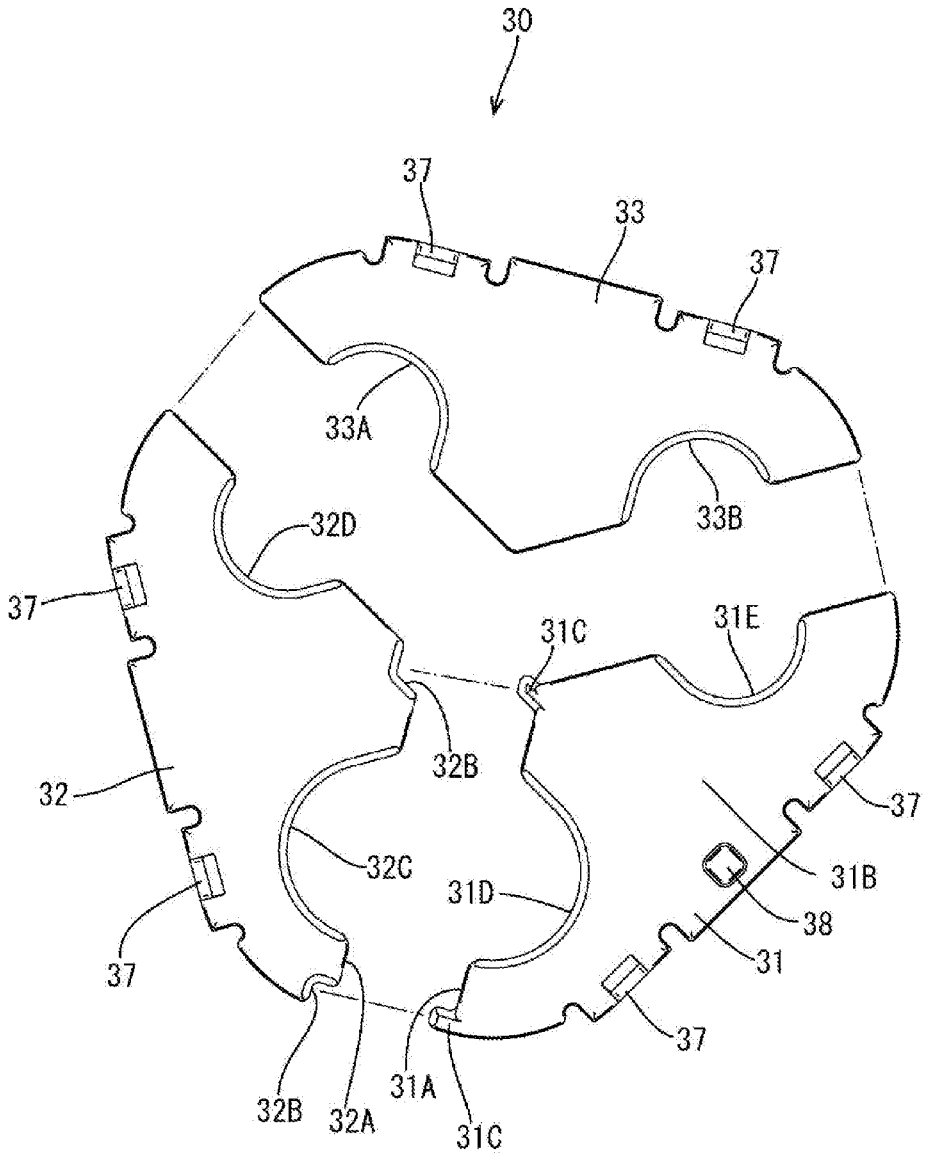
FIG. 4 is a rear view of the retainer before each divided body is assembled.
Figure 5:
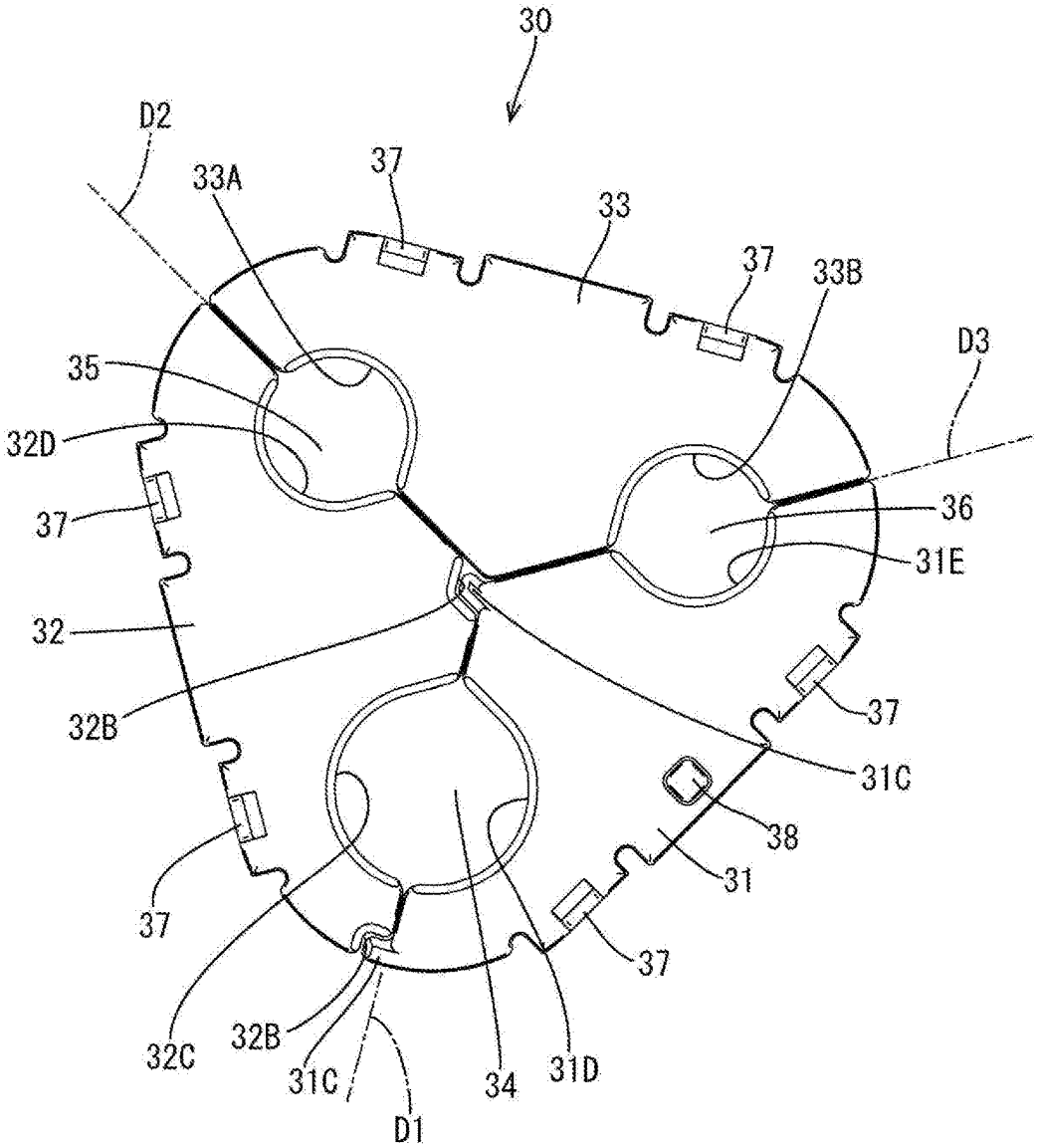
FIG. 5 is a rear view of the retainer after each divided body is assembled.

As shown in FIGS. 2 and 3, a retainer mounting portion 14 is provided in the housing 11 around the wire accommodating portions 15 for receiving the back retainer 30. As shown in FIGS. 3 and 4, the back retainer 30 is composed of a first, second and third divided bodies 31, 32 and 33. The back retainer 30 has a substantially triangular shape with rounded vertices part. Further, the respective divided bodies 31, 32 and 33 are divided at positions of three division lines D1, D2 and D3 extending toward a center from the respective vertices of the back retainer 30.

The first and second divided bodies 31, 32 are divided at the position of the division line D1, the second and third divided bodies 32, 33 are divided at the position of the division line D2, and the third and first divided bodies 33, 31 are divided at the position of the division line D3. The first divided body 31 has a facing surface 31A facing the second divided body 32 at the position of the division line D1. The second divided body 32 has a facing surface 32A facing the first divided body 31 at the position of the division line D1. The facing surface 31A of the first divided body 31 and the facing surface 32A of the second divided body 32 faces each other at the position of the division line D1.

The back retainer 30 includes through holes 34, 35 and 36 allowing the passage of wires W at the positions of the respective division lines D1, D2 and D3. The through hole 34 at the position of the division line D1 allows, for example, the passage of the wire W having a large diameter of 30 mm2, and the through holes 35 and 36 at the positions of the division lines D2 and D3 have smaller diameters than the through hole 34 and are of the same size to allow, for example, the passage of the wires W having a diameter of 20 mm2.

The large-diameter through hole 34 is defined by a first semicircular portion 31D on the facing surface 31A of the first divided body 31 and a semicircular portion 32C on the facing surface 32A of the second divided body 32. The small-diameter through hole 35 is defined by a third semicircular portion 32D on the second divided body 32 and a fourth semicircular portion 33A on the third divided body 33. Further, the small-diameter through hole 36 is defined by a fifth semicircular portion 33B on the third divided body 33 and a sixth semicircular portion 31E on the first divided body 31.

Further, two lock pieces 37 are provided at positions corresponding to the respective through holes 34, 35 and 36 on the outer peripheral edge of each of the divided bodies 31, 32 and 33. These lock pieces 37 are locked to a plurality of lock protrusions 14A provided on the outer peripheral surface of the retainer mounting portion 14, as shown in FIG. 3. In this way, the respective divided bodies 31, 32 and 33 are fixed in the retainer mounting portion 14. Thus, the rubber plugs 20 can be retained by the respective divided bodies 31, 32 and 33.

The back retainer 30 is composed of the three different divided bodies 31, 32 and 33 and an existing product is used as the third divided body 33. On the other hand, the retainer mounting portion 14, into which the back retainer 30 is to be mounted, includes a first mounting portion 16 into which the first divided body 31 is to be mounted, a second mounting portion 17 into which the second divided body 32 is to be mounted and a third mounting portion 18 into which the third divided body 33 is to be mounted. As shown in FIG. 2, the respective mounting portions 16, 17 and 18 are shaped identically. Thus, there is a possibility of an assembling error of, for example, erroneously mounting the third divided body 33 into the first mounting portion 16 or erroneously mounting the third divided body 33 into the second mounting portion 17.

Confirmation that the first divided body 31 is mounted into the first mounting portion 16 is made using a contact-type sensor. To this end, the first divided body 31 has a sensor detected portion 38 that projects back (in an axial direction of the wire W) from a back surface 31B of the first divided body 31 adjacent to the facing surface 31A. The contact-type sensor senses the sensor detected portion 38 and judges the presence of the sensor detected portion 38 if the first divided body 31 is mounted properly in the first mounting portion 16. An assembling error is detected if the absence of the sensor detected portion 38 is judged. Note that conformation that the third divided body 33 is mounted into the third mounting portion 18 can be made using a color sensor.

Confirmation that the second divided body 32 is mounted into the second mounting portion 17 is made not by a sensor, but based on whether or not projections 31C on the first divided body 31 and recesses 32B on the second divided body 32 can fit together. Two of the projections 31C are at opposite sides of the first semicircular portion 31D on the facing surface 31A of the first divided body 31 and two of the recesses 32B are at opposite sides of the second semicircular portion 32C on the facing surface 32A of the second divided body 32. The projections 31C project toward the second divided body 32 from the facing surface 31A as a reference. When the first divided body 31 is mounted into the first mounting portion 16 and the second divided body 32 is mounted into the second mounting portion 17, the projections 31C are fit into the two recesses 32B and each lock piece 37 is locked to each lock protrusion 14A, as shown in FIG. 3. Thus, it is detected that the first and second divided bodies 31, 32 have been mounted at proper mounting positions.

Figure 6:
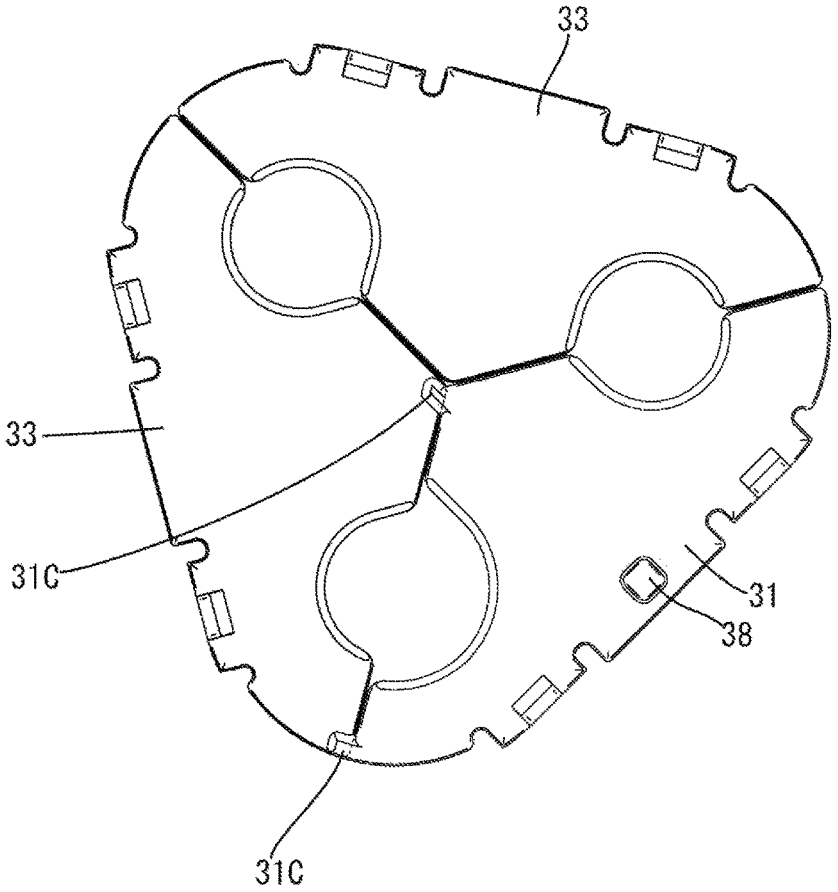
FIG. 6 is a view showing a state where an attempt is made to assemble a first divided body with an existing product.
Figure 7:
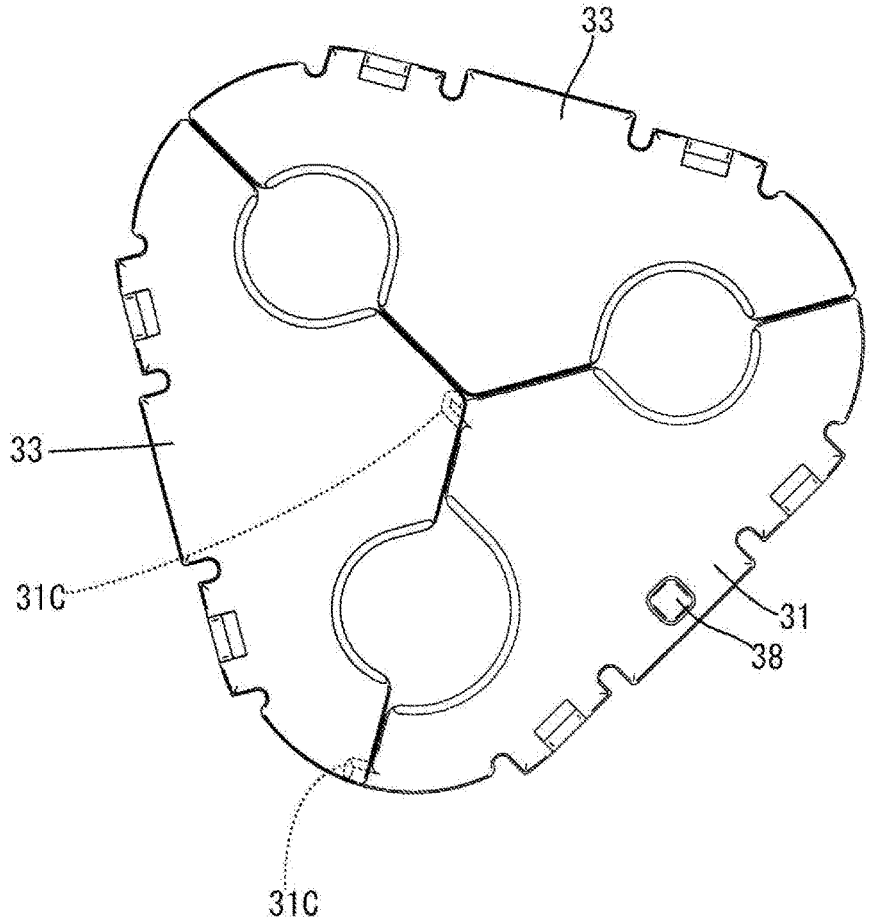
FIG. 7 is a view showing a state where an attempt is made to assemble the existing product with the first divided body.

An attempt could be made to mount the first divided body 31 into the first mounting portion 16 after the third divided body 33 is mounted erroneously into the second mounting portion 17, as shown in FIG. 6. However, the projections 31C interfere with the third divided body 33 to obstruct the mounting of the first divided body 31. In this way, an assembling error of the third divided body 33 is detected. Further, an attempt could be made to mount the third divided body 33 erroneously into the second mounting portion 17 after the first divided body 31 is mounted into the first mounting portion 16, as shown in FIG. 7. However, the third divided body 33 interferes with the two projections 31C to obstruct the mounting of the third divided body 33. In this way, an assembling error of the third divided body 33 is detected.

As described above, an assembling error is detected by the sensor if the existing product without the sensor detected portion 38 is mounted erroneously into the first mounting portion 16. Further, an attempt could be made to mount the existing product without the recesses erroneously into the second mounting portion 17 after the first divided body 31 is mounted into the first mounting portion 16. However, the existing product interferes with the projections 31C so that an assembling error is detected. An attempt also could be made to mount the first divided body 31 into the first mounting portion 16 after the existing product is mounted erroneously into the second mounting portion 17. However, the projections 31C of the first divided body 31 interfere with the existing product so that an assembling error is detected. Thus, an inspection device such as a sensor is not needed to confirm that the second divided body 32 is mounted into the second mounting portion 17.

The retainer retainer 30 may include the through hole 34 allowing the passage of the wire W, and the through hole 34 may be the space enclosed by the first semicircular portion 31D on the first divided body 31 and the second semicircular portion 32C on the second divided body 32. Additionally, the sensor detected portion 38 may project in the axial direction of the wire W from the back surface 31B of the first divided body 31. Thus, an assembling error can be detected by the contact-type sensor sensing the presence or absence of the sensor detected portion 38.

Two projections 31C may be at opposite sides of the first semicircular portion 31D and two recesses 32B may be at opposite sides of the semicircular portion 32C. The projections 31C fit into the recesses 32B to detect proper assembly.

The technology disclosed by this specification is not limited to the above described and illustrated embodiment and includes, for example, various modes described as below.

The presence or absence of a sensor detected portion 38 is sensed by a contact-type sensor in the above embodiment. However, a sensor detected portion may be sensed by a color sensor.

Although two projections 32C are fit into two recesses 32B in the above embodiment, one projection may be fit into one recess.

The back retainer 30 is composed of the three divided bodies 31, 32 and 33 in the above embodiment. However, a back retainer composed of two divided bodies may be adopted.

Although the back retainer 30 for retaining the rubber plugs 20 is disclosed, a retainer for holding members (e.g. wires) other than the rubber plugs 20 may be adopted.

LIST OF REFERENCE SIGNS

10 . . . waterproof connector
11 . . . housing
14 . . . retainer mounting portion
15 . . . first mounting portion
16 . . . second mounting portion
30 . . . back retainer
31 . . . first divided body
31A . . . facing surface
31B . . . back surface
31C . . . projection
31D . . . first semicircular portion
32 . . . second divided body
32A . . . facing surface
32B . . . recess
32C . . . second semicircular portion
34 . . . through hole
38 . . . sensor detected portion
W . . . wire

What is claimed is:

1. A connector, comprising:

a housing having opposite front and rear ends and accommodating first, second and third terminals connected respectively to first, second and third wires so that the wires extend from the rear end of the housing, at least the first wire having a diameter different from diameters of the second and third wires, a retainer mounting portion being formed at the rear end of the housing; and a retainer mounted in the retainer mounting portion of the housing, the retainer being formed from the first, second and third divided bodies, the first and second divided bodies abutting one another along a first division line, the second and third divided bodies abutting one another along a second division line and the third and first divided bodies abutting one another along a third division line, first, second and third through holes being formed through the retainer at the respective first, second and third division lines and defining diameters corresponding to the respective diameters of the first, second and third wires, the first divided body having at least one projection projecting toward the second divided body at the first division line and the second divided body having at least one recess at the first division line, the at least one recess receiving the at least one projection when the first, second and third divided bodies are assembled correctly with one another in the retainer mounting portion, and a sensor-detectable surface discontinuity extending in a front-rear direction on the first divided body at a specified position for detection by a sensor to confirm that the first divided body is in a specified position in the retainer mounting portion.

2. The connector of claim 1 wherein the at least one projection on the first divided body comprises two projections on opposite sides of the first through hole and the at least one recess on the second divided body comprises two recesses on opposite sides of the first through hole and at positions to receive the projections of the first divided body when the first, second and third divided bodies are assembled correctly with one another in the retainer mounting portion.

3. The connector of claim 1, wherein the through holes are formed by semicircular recesses in the divided bodies that abut one another at the respective division lines.

4. The connector of claim 1, wherein the diameters of the second and third through holes are substantially equal.

5. The connector of claim 4, wherein the diameter of the first through hole is greater than the diameters of the second and third through holes.

6. The connector of claim 1, wherein the retainer mounting portion and the retainer are substantially triangular.

7. The connector of claim 6, wherein each of the divided bodies is substantially triangular.

* * * * *